United States Patent [19]

Wolford

[11] 4,377,268

[45] Mar. 22, 1983

[54] STAND FOR MUSICAL INSTRUMENTS

[76] Inventor: John W. Wolford, P.O. Box 1024, Dell Lake Village, Dundee, Fla. 33838

[21] Appl. No.: 171,739

[22] Filed: Jul. 24, 1980

[51] Int. Cl.[3] ..... A45D 19/04

[52] U.S. Cl. ..... 248/176; 248/121

[58] Field of Search ..... 248/177, 176, 178, 165, 248/121, 122, 167; 524; 84/453

[56] References Cited

U.S. PATENT DOCUMENTS

| | | | |
|---|---|---|---|
| 1,464,279 | 8/1923 | Hindley | 248/167 X |
| 1,734,577 | 11/1929 | Henry | 248/121 |
| 1,900,718 | 3/1933 | Lang | 248/121 UX |
| 2,007,574 | 7/1935 | Lang | 248/167 |
| 2,153,821 | 4/1939 | Walberg | 248/121 |
| 2,459,533 | 1/1949 | Irvin | 248/524 X |
| 2,671,624 | 3/1954 | Carney | 248/524 |
| 4,161,131 | 7/1979 | Blayman | 84/453 |

*Primary Examiner*—J. Franklin Foss

*Attorney, Agent, or Firm*—Duckworth, Allen, Dyer & Pettis

[57] ABSTRACT

The present invention is used in conjunction with a musical instrument having a bell including a tapered inner surface, an upper end and a lower end. The stand includes a round disc having upper and lower surfaces, and a side surface formed from an elastomeric material. The side surface gradually tapers inward between the lower and upper surfaces of the disc. The diameter of the lower surface of the disc is slightly greater than the diameter of the inner surface of the lower portion of the bell of the musical instrument. The dimensions of the disc and the inclination of the side surface of the disc cause the disc to exert a frictional locking force between the side surface of the disc and the bell of the musical instrument to maintain the musical instrument in a fixed position with respect to the disc. A base is coupled to the disc and maintains the disc in a level position.

7 Claims, 3 Drawing Figures

STAND FOR MUSICAL INSTRUMENTS

BACKGROUND OF THE INVENTION

1. Field of the Invention

This invention relates to stands for musical instruments, and more particularly, to stands for musical instruments having a bell-shaped end.

2. Description of the Prior Art

The prior art discloses numerous different configurations of stands for vertically supporting a musical instrument having a bell-shaped end.

U.S. Pat. No. 3,637,070 (Friedman) discloses a trumpet stand which utilizes a trumpet carrying case as a base for the trumpet supporting element. A shaft is rigidly coupled at one end to the upper surface of the carrying case. A cone-shaped plug is coupled to the opposite end of the shaft and includes two separate frictional rings which extend around the circumference of the upper and lower ends of the cone. The cone-shaped plug contacts the bore of the trumpet along a substantial distance of the trumpet barrel to maintain the trumpet in a vertical position.

U.S. Pat. No. 1,268,363 (Lamont) discloses a collapsible stand for musical instruments. A vertical rod extends upward from a collapsible base and includes a rounded head which prevents the musical instrument from falling from the stand. Three separate cushion blocks are coupled to elements of the base which extend upward from the legs of the base to contact the interior of the bell of the musical instrument to thereby vertically support the musical instrument. U.S. Pat. No. 2,920,851 (Carlini) discloses a collapsible stand for a cornet. This stand includes an outwardly sweeping lower section having a cork exterior protective layer. The configuration of this lower section is approximately equal to the sweep of the interior section of the bell of the cornet and provides vertical support for the cornet. This stand also includes a vertically extending main column having a plurality of protruding instrument bracing spring fingers for preventing lateral displacement of the instrument from the stand.

U.S. Pat. No. 3,203,298 (Sumrall) discloses a combination clarinet and reed holder. This multi-element device is held together by a rubber band and encloses a clarinet reed. When a clarinet is stored within a case, the musical instrument holder fits within the recess of the clarinet bell. The stand can be removed from the end of the clarinet and secured to the upper surface of the clarinet stand. The weight of the clarinet rests on and is supported by the upper surface of the clarinet case. The clarinet stand by being rigidly secured to the upper surface of the clarinet case prevents lateral displacement of the clarinet with respect to the stand. The angle of inclination of the exterior surface of the clarinet stand is contoured to fit and interface with the contour of the inner bore of the clarinet bell.

U.S. Pat. No. 4,161,131 (Balyman) discloses a musical instrument supporting stand which includes a plurality of air vent channels for conducting air into the interior of the instrument. The angled side surfaces of this stand are dimensioned to to match the configuration of the bore of the bell end of the musical instrument. The upper end of this stand penetrates a substantial distance into the interior of the instrument beyond the bell. The vertical weight of the musical instrument is supported by a flat horizontal extension of the base. The prior art includes other variations of the musical instrument stands discussed above.

SUMMARY OF THE INVENTION

It is therefore a primary object of the present invention to provide a stand for a musical instrument having a bell end which includes an elastomeric disc for exerting a frictional locking force between the side surface of the disc and the lower part of the bell of the musical instrument to maintain the musical instrument in a fixed position with respect to the disc.

Another object of the present invention is to provide a musical instrument stand which includes a bracket having a clip positionable around the exterior surface of the upper end of the musical instrument bell for stabilizing the musical instrument in a vertical position.

Yet another object of the present invention is to provide a musical instrument stand which permits a musical instrument to be readily removed from and replaced in the stand.

Still another object of the present invention is to provide a musical instrument stand which is compact and inexpensive to manufacture.

Briefly stated, and in accord with one embodiment of the invention, a stand is provided for a musical instrument having a bell including a tapered inner surface, an upper end and a lower end. This stand includes a disc having upper and lower surfaces and a side surface formed from an elastomeric material. The side surface of the disc gradually tapers inward between the lower and upper surfaces of the disc. The lower surface of the disc has a diameter slightly greater than the diameter of the inner surface of the lower end of the bell for exerting a frictional locking force between the side surface of the disc and the bell to maintain the musical instrument in a fixed position with respect to the disc.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
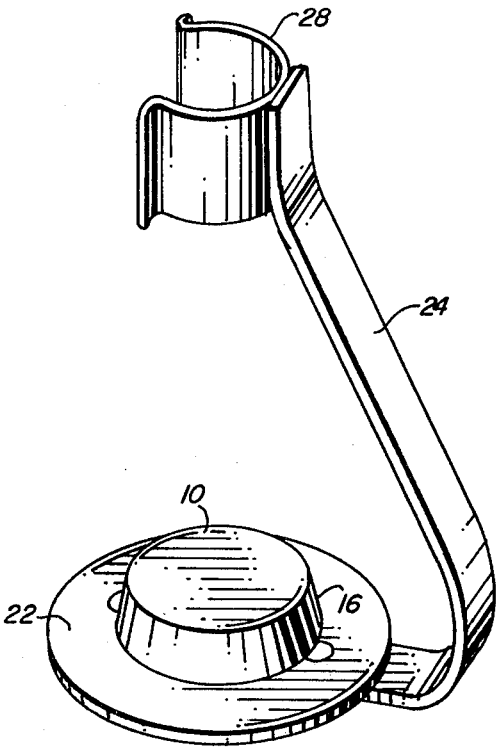
FIG. 1 is a perspective view of the musical instrument stand of the present invention.
Figure 2:
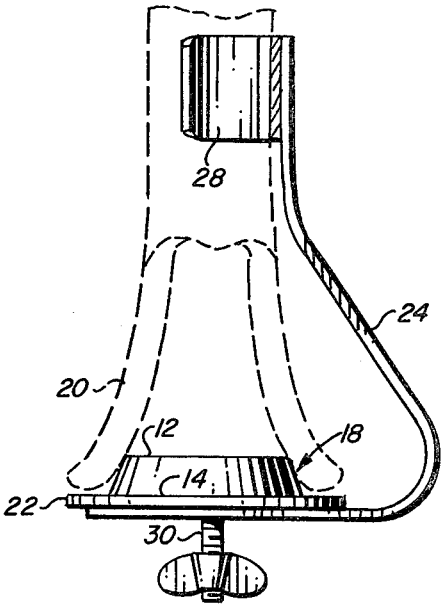
FIG. 2 is a partially cut away elevational view of the musical instrument stand illustrated in FIG. 1.

Referring now to FIGS. 1 and 2, the stand of the present invention includes a round disc 10 having upper and lower surfaces 12 and 14. The side surface 16 of disc 10 gradually tapers inward between lower surface 14 and upper surface 12 of disc 10. The diameter of the lower portion of side surface 16 is slightly greater than the diameter of the inner surface of the lower end section 18 of bell 20.

Figure 3:
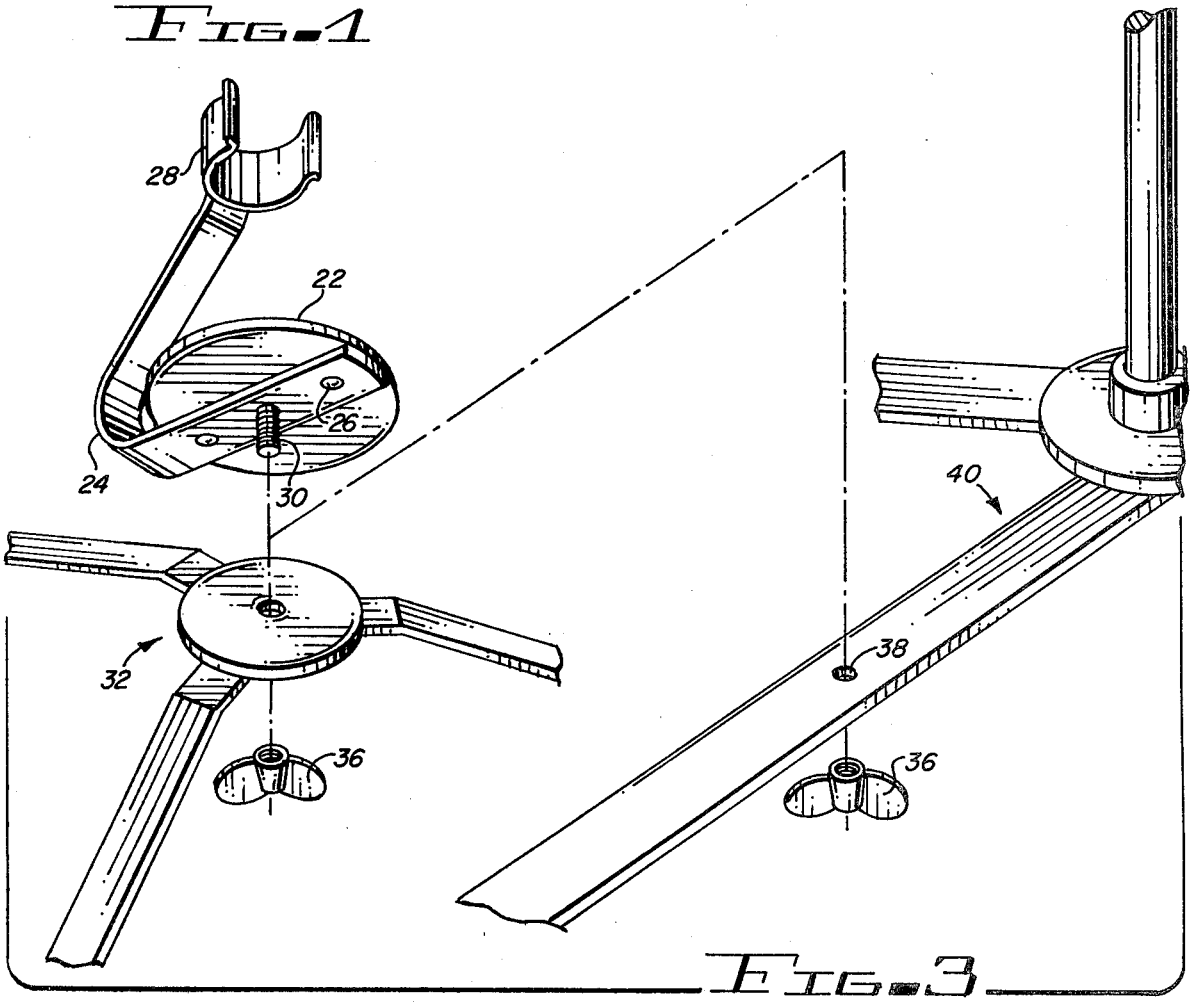
FIG. 3 is a partial elevational view showing how the musical instrument stand of the present invention can be supported by a separate base or can be coupled to a base used for a different purpose.

A rigid support plate 22 is coupled to the lower surface 14 of disc 10 and serves to maintain the lower surface 14 of disc 10 in an essentially flat configuration. Disc 10 can either be mechanically or adhesively secured to support plate 22. The first end of a bracket 24 is coupled as shown to the lower surface of support plate 22 by securing means 26 as illustrated in FIG. 3 or by an adhesive. A semi-circular or C-shaped clip 28 is coupled to the opposite end of bracket 24. Clip 28 is generally covered with a soft material such as felt in order to prevent damage to the exterior surface of the musical instrument when the instrument is inserted into the interior of clip 28 as shown in FIG. 2.

Referring now to FIGS. 2 and 3, a threaded shaft 30 is coupled to and extends vertically downward from support plate 22 through an aperture in bracket 24. The upper end of shaft 30 can be either spot welded to support plate 22 or can be mechanically secured thereby by various means well known to those skilled in the art. Shaft 30 is generally fabricated from an 8–32 threaded shaft.

Referring now to the left-hand side of FIG. 3, a base 32 includes a plurality of legs as illustrated. Threaded shaft 30 extends through an aperture 34 in the center of base 32. Wing nut 36 is secured to shaft 30 on the opposite side of base 32 and thereby rigidly secures shaft 30 to stand 32.

In the alternative embodiment illustrated in the right-hand side of FIG. 3, threaded shaft 30 of the stand of the present invention passes through an existing aperture 38 in another base or stand 40. Aperture 38 is typically a $\frac{1}{4}$–20 or 10–24 threaded aperture which permits the 8–32 size threaded shaft 30 to pass through without contact between the threads on shaft 30 with the threads within aperture 38. Wing nut 36 couples the stand of the present invention to stand 40 in a manner identical to that discussed in connection with base 32. Stand 40 may be a saxaphone tripod, a music stand or any one of a variety of related types of multi-leg stands.

Disc 10 is typically manufactured from an elastomeric material such as Neopreen. In the preferred embodiment illustrated bracket 24 is manufactured from $\frac{1}{8}$" thick tempered steel while clip 28 is manufactured from 1/16" thick tempered steel. The reduced thickness of clip 28 enhances the spring effect of this device and facilitates removal and insertion of a musical instrument within clip 28.

The music stand of the present invention is typically used as a stand for a clarinet. Disc 10 is dimensioned so that downward displacement of the lower end of the clarinet bell onto the side surface 16 of disc 10 causes the disc to exert an outward biasing force on the inner bore of the clarinet bell, creating a frictional locking force between the side surface of the disc and the interior surface of the clarinet bell. This frictional locking force maintains the clarinet or other musical instrument in a fixed position with respect to the disc. Spring clip 28 provides a secondary mechanical coupling between the lower section of the musical instrument and the stand of the present invention. The locking force exerted by disc 10 and by clip 28 on the musical instrument permits a musician to move his musical instrument and the stand as a unit and thus substantially increases the portability of the invention over that available with many related prior art type stands. Because of the minimal penetration of disc 10 into the interior of the bore of the musical instrument and because of the properties of the elastomeric material from which disc 10 is manufactured, the interior bore of the instrument is neither scratched nor otherwise defaced as frequently occurs when one of the many prior art stands is used.

It will be apparent to those skilled in the art that the disclosed musical instrument stand may be modified in numerous ways and may assume many embodiments other than the preferred forms specifically set out and described above.

For example, by increasing the size of the stand, it would be possible to use the stand of the present invention in combination with other types of musical instruments having a bell end. In certain embodiments, it may be advantageous to delete bracket 24 and clip 28. Many different types of elastomeric materials could be used for disc 10. It might be preferrable in some embodiments to incorporate a rigid material such as wood in the inner portion of disc 10 and to provide an elastomeric material only around the outer surface of the disc.

Accordingly, it is intended by the appended claims to cover all such modifications of the invention which fall within the true spirit and scope of the invention.

I claim:

1. A stand for a musical instrument having a bell including a tapered inner surface, an upper end and a lower end, said stand comprising:

a. a round disc having upper and lower surfaces and a side surface gradually tapering inward between the lower and upper surfaces of said disc, the lower surface of said disc having a diameter slightly greater than the diameter of the inner surface of the lower end of the bell for exerting a frictional locking force between the side surface of said disc and the bell to maintain the musical instrument in a fixed position with respect to said disc whereby the upper surface of the disc cannot penetrate into the upper end of the inner surface of the bell;

b. a base coupled to said disc for maintaining the lower surface of said disc in a level position;

c. a bracket having a first end coupled to said base and a second end positionable around the exterior surface of the bell for stabilizing the musical instrument in a vertical position, said second end of said bracket including a C-shaped element having a diameter approximately equal to the outer diameter of the bell.

2. The stand of claim 1 wherein said C-shaped element is fabricated from a spring-like material.

3. The stand of claim 1 wherein said C-shaped element is covered with a soft material.

4. A stand for a musical instrument having a bell including a tapered inner surface, an upper end and a lower end, said stand comprising:

a. a round, elastomeric disc having upper and lower surfaces, and a side surface, the side surface gradually tapering inward between the lower and upper surfaces of said disc, the lower surface of said disc having a diameter slightly greater than the diameter of the inner surface of the lower end of the bell for exerting a frictional locking force between the side surface of said disc and the bell to maintain the musical instrument in a fixed position with respect to said disc whereby the upper end of the disc cannot penetrate into the upper end of the inner surface of the bell;

b. a rigid support plate coupled to the lower surface of said disc for supporting the lower surface of said disc;

c. a bracket having a first end coupled to said support plate and a second end having a C-shaped clip positionable around the exterior surface of the upper end of the bell for stabilizing the musical instrument in a vertical position;

d. a base coupled to said support plate for maintaining the lower surface of said disc in a level position; and e. means for detachably coupling and disc to said base.

5. The stand of claim 4 wherein said C-shaped clip is fabricated from a spring-like material.

6. The stand of claim 4 wherein said clip is covered with a soft material.

7. The stand of claim 4 wherein said bracket is fabricated from a rigid, spring-like material.

* * * * *